United States Patent [19]

Marulic et al.

[11] 4,158,996

[45] Jun. 26, 1979

[54] LOCKING ARRANGEMENT FOR HOPPER CAR DOORS

[75] Inventors: Walter J. Marulic, Gary, Ind.; Ray L. Ferris, Thornton, Ill.

[73] Assignee: Pullman Inc., Chicago, Ill.

[21] Appl. No.: 832,127

[22] Filed: Sep. 12, 1977

[51] Int. Cl.[2] ..... B61D 7/18

[52] U.S. Cl. ..... 105/308 R; 292/207; 292/216

[58] Field of Search ..... 105/308 R, 308 C; 292/207, 216

[56] References Cited

U.S. PATENT DOCUMENTS

| | | | |
|---|---|---|---|
| 2,381,633 | 8/1945 | Young | 292/207 X |
| 3,121,405 | 2/1964 | Smith | 105/253 |
| 4,036,517 | 7/1977 | Tallmadge | 292/216 |

*Primary Examiner*—Robert G. Sheridan

*Attorney, Agent, or Firm*—Richard J. Myers

[57] ABSTRACT

A locking arrangement for side dump discharge doors of a hopper car includes a keeper arrangement for receiving a rod type latch element with the keeper comprising a cylindrical housing containing a locking rotor. The rotor includes an open end slot which captures the latch element and rotates between locked and open positions.

24 Claims, 4 Drawing Figures

LOCKING ARRANGEMENT FOR HOPPER CAR DOORS

BACKGROUND OF THE INVENTION

1. Field of the Invention

The invention relates to open top hopper cars having bottom side discharge openings and doors therefor. More specifically it relates to a locking arrangement for side discharge doors.

2. Description of the Prior Art

The prior art is exemplified in U.S. Pat. Nos. 1,800,161, Apr. 7, 1931; 2,970,551, Feb. 7, 1961; 3,121,405, Feb. 18, 1964; 3,667,791, June 6, 1972; and 3,667,793, June 6, 1972.

SUMMARY OF THE INVENTION

The present hopper car of the invention is of the open top type having an elongated hopper particularly suited for the discharge of wood chips in lumbering operations and also being capable of transporting and discharging cut logs and similar materials through bottom and side discharge openings which discharge to opposite sides of the car, the openings being closed by swinging doors actuated from track side camming mechanisms. The present invention relates particularly to a locking arrangement for maintaining the doors in a closed position.

Each locking arrangement comprises a housing having a cylindrical housing portion within which is provided a cylindrical cavity for rotatably supporting therein a locking rotor. The housing consists of a relatively thick central plate which is provided with an elongated aperture or a slot supporting therein a plunger. The housing is enclosed by outer plates connected to the central housing plate and the cylindrical housing portion is provided with a gathering slot adapted to register with an open end notch or slot of the rotor to receive a latch pin or rod supported on the lower end of an adjacent hinged door. Upon closing movement of the door the latch rod enters into the gathering slot of the housing, engages the cavity of the rotor and rotates the same to a closed or locked position, when assuming this position the sliding latch member enters into a slot provided in the peripheral outer surface of the rotor and locks the rotor against rotation. The housing includes a spring which maintains the plunger in its locked position. The plunger is also connected by means of a link to a clevis and link arrangement by a lost motion connection. A tube extends longitudinally underneath the hopper car and supports a plurality of crank arms which are adapted to move the linkage arrangements laterally for disengaging the plunger to permit the rotor to assume an open position for releasing the locked door. Piston type spring devices are also connected to the crank arms and linkage arrangements for tensioning the linkages in a certain position.

DESCRIPTION OF THE PREFERRED EMBODIMENT

Figure 1:
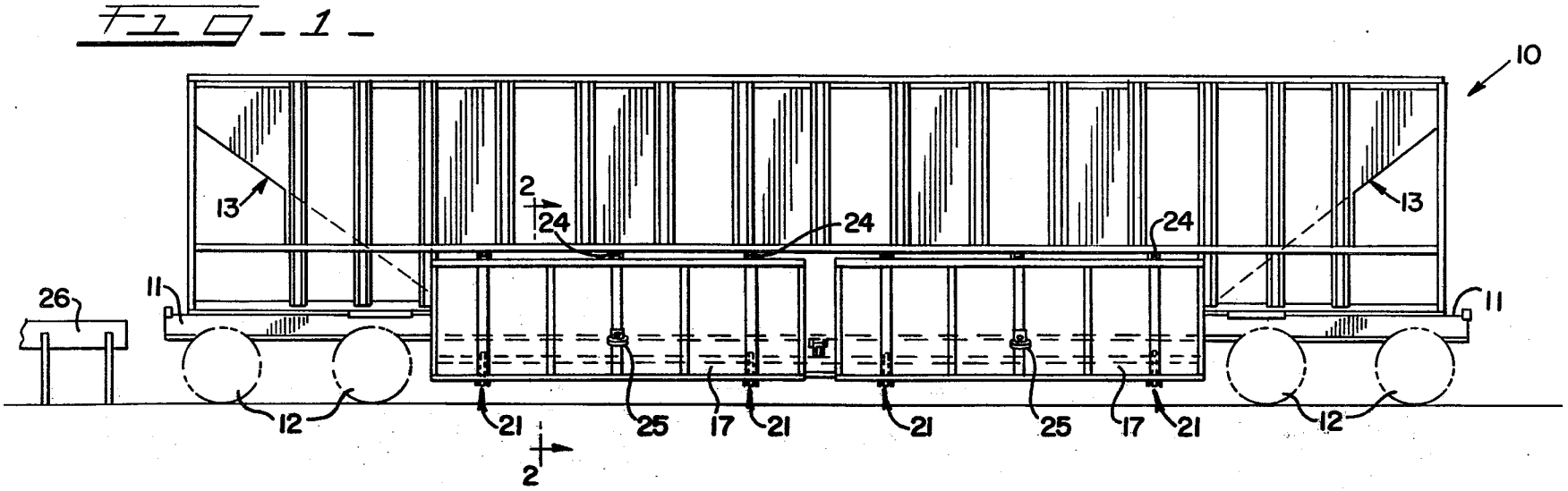
FIG. 1 is a side elevational view of an improved railway hopper car embodying the present invention.
Figure 2:
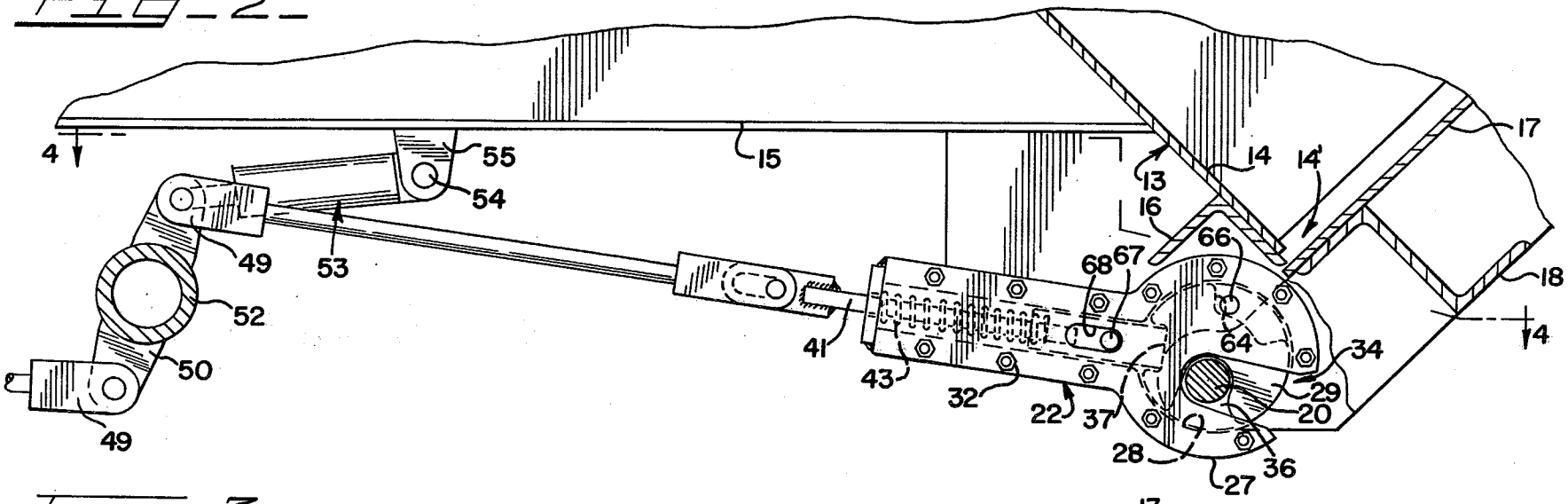
FIG. 2 is a cross-sectional view through one side of the hopper car taken substantially along the line 2—2 of FIG. 1.
Figure 3:
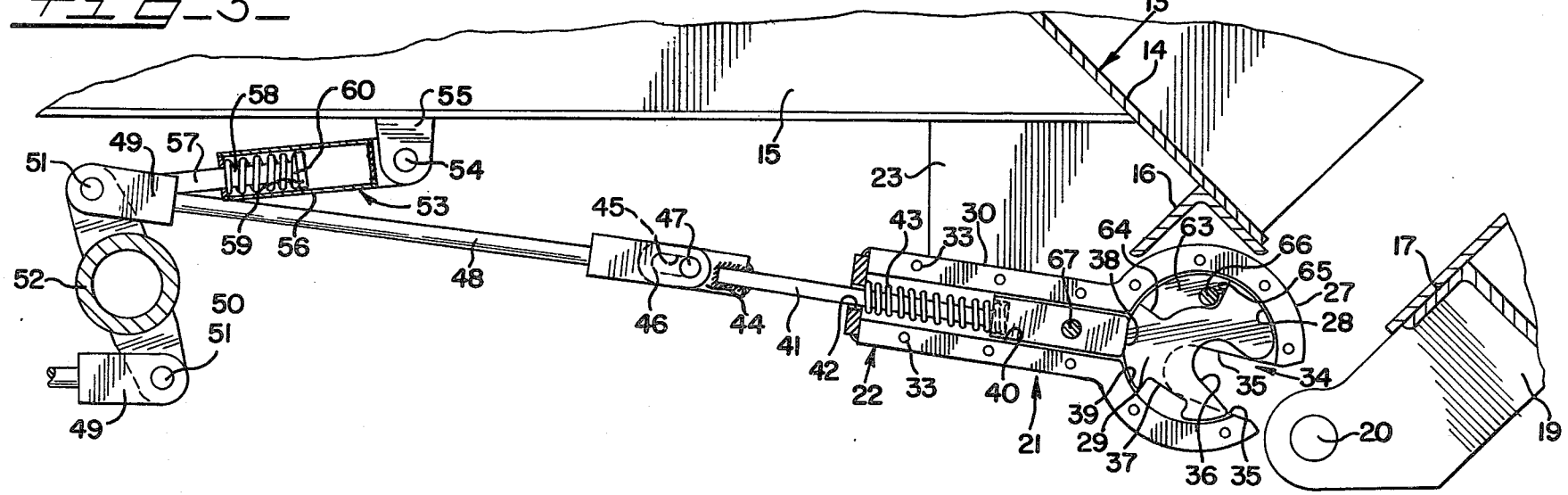
FIG. 3 is a cross-sectional view similar to FIG. 2 showing an open position of a locking mechanism.

FIG. 1 discloses a hopper car 10 of the open top type which includes an underframe 11 suitably mounted on wheel trucks 12. Interior hoppers of the car are designated at 13 and each includes longitudinally extending downwardly and outwardly diverging slop sheets 14 which are supported on transversely extending supports 15. As best shown in FIG. 2 the lower ends of the slope sheets 14 include longitudinally extending reinforcing angles 16. Also as best shown in FIG. 2 the slope sheets 14 are oriented in such a manner as to discharge materials from the hoppers 13 downwardly and outwardly through discharge openings generally designated at 14'. Each of the openings 14' is adapted to be closed by means of doors 17 which are suitably hinged as indicated in FIG. 1 by a plurality of hinge members to swing downwardly and outwardly relative to the openings 14'. Each of the doors also as best shown in FIGS. 2 and 3 includes longitudinally extending reinforcing Z-shaped stringers 18. The stringers 18 support downwardly projecting latch plate members 19 suitably spaced to support a longitudinally extending latch bar 20.

A locking arrangement of each of the doors is generally designated at 21 and comprises a housing 22 suitably connected to the transverse supports 15 by means of a vertically extending support plate 23. As best shown in FIG. 1 each of the doors has also connected thereto on its outer sides roller or wheel members 25 which are adapted to engage track side cams 26 which swing the doors inwardly as the car passes along the cams to close them as shown in FIG. 2. Each of the locking arrangements 21 as best shown in FIG. 1 is provided adjacent opposite ends of each of the doors 17, two doors being provided on each side of the hopper car for permitting the discharge of materials from the hoppers therein. Each locking arrangement 21 includes a cylindrical housing portion 27 provided with a cylindrical cavity 28. The cylindrical housing portion 27 is provided in a central thick plate member 30 and a rotor 29 is suitably positioned for generally concentric rotation within the cylindrical cavity 28. Outer plate covers 31 include threaded holes 33 supporting fasteners 32 which secure the covers 31 to the central thick plate member 30. The cylindrical housing portion 27 is provided with a gathering slot 34 having gathering side walls 35. The rotor 29 includes an open end notch 36 adapted to register with the gathering slot 34 in the open position to release the adjacent door 17 from locked relation. The outer peripheral edge of the rotor 29 also is provided with a recess 37 which is adapted to be engaged by a plunger 38 as best shown in FIG. 2 to lock the rotor 29 against rotation. The outer peripheral surface of the rotor 29 is designated at 39. The plate member 30 is provided with a slot 40 within which the plunger 38 is adapted to reciprocate. The plunger 38 in turn is rigidly connected to a link 41 extending through an apertured plate or spring retainer 42. A coil spring 43 is held captive between the plate 42 and the plunger 38 continually urges the plunger to the closed position shown in FIG. 2. One end of the link 41 is connected to a slotted plate 44 having a slot 45. A clevis 46 includes a pin 47 adapted to move longitudinally within the slot 45 to provide therewith a lost motion connection. The clevis 46 is connected to a link 48 which at its end also is provided with a clevis 49 pivotally connected to a crank arm 50 by means of a pivot pin 51. The crank arm 50 is suitably connected to a longitudinally extending operating tube 52 extending longitudinally underneath the car for actuating the door locking mechanism for each door. Rotation of the tube 52 which may be either manual or motor actuated and provides for the disengagement of the locking mechanism to permit the door to swing to the unlocked position as shown in FIG. 3. The links 48 extend to opposite sides of the car so that the doors on opposite sides are thus actuated.

As best shown in FIGS. 2 and 3 piston type spring devices 53 urge to linkage arrangement into the position shown in FIG. 3. Each spring device 53 is suitably connected by means of pivot means 54 to brackets 55 supported on the underneath side of the supports 15. Each spring device includes a housing 56 slidably supporting a piston 59 connected to a piston rod 57 which extends through an opening 58 at one end of the housing 56. The spring 60 is captured within the housing 56 for urging the piston 59 to the position shown in FIG. 3 for maintaining the crank arm 50 in the position indicated.

Figure 4:
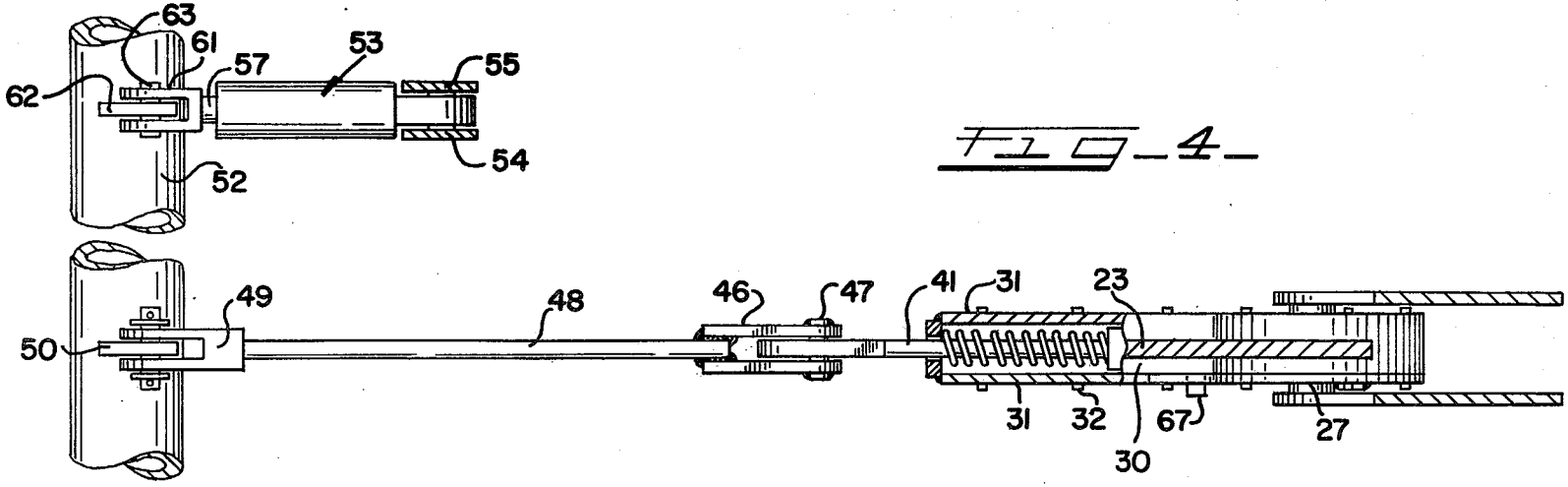
FIG. 4 is a cross-sectional view taken substantially along the line 4—4 of FIG. 2.

As best shown in FIG. 4 the piston rod 57 is connected to a clevis 61 which in turn is connected to a bracket 62 by means of a pivot pin 63 said bracket 62 being suitably connected to the outer surface of the tube 52. As best shown in FIG. 3 the rotor 29 is also provided with a stop recess or cavity 63 having end walls or stops 64 and 65 which are engaged by means of a stop pin 66 during rotation of the rotor to its open and closed positions. In FIG. 2 the stop pin 66 engages the wall 64 and the recess 37 is engaged by the plunger 38 to lock the rotor in position. The wall 65 as best shown in FIG. 3 maintains the rotor in the open position as indicated. An indicator 67, as best shown in FIGS. 2 and 3 is secured to the plunger 38 and projects outwardly with respect thereto through a slot 68 provided in the outer plate 31. The position of the indicator pin 67 thus indicates to the operator whether or not the plunger is in its closed or locked position as shown in FIG. 2 or whether it is in its open position at the end of the slot 68 as shown in FIG. 3.

The Operation

During shipment of logs, wood chips or other materials within the hopper car 10 the doors are in the locked position shown in FIG. 2 wherein the plungers 38 are engaged within the recesses 37 locking the rotor and latch bars 20 in the position wherein the doors are solidly locked. When the car reaches its destination the operator actuates the longitudinal tube 52 to move to the position indicated in FIG. 3, wherein the latch bar 38 is retracted and the rotor 29 is moved to the open position shown, wherein the door is open since the latch bar 20 is now free to be disengaged through the gathering opening 34. Thus the doors are simultaneously opened and the load is quickly and easily discharged through the side openings. Upon discharge of the load the operator then again moves the tube 52 to the position indicated in FIG. 2. At this point however the end of the plunger 38 is in engagement with the outer peripheral surface 39 of the rotor 29 in the position of FIG. 3. As the car moves along the track the door rollers 25 are engaged by the cam 26 which swings the doors inwardly to the closed position wherein each of the latch bars 20 passes through the gathering openings 34 and engages the open end notches 36. This rotates the rotors in a clockwise direction until the recesses 37 are in registry with the ends of the plungers 38 whereupon the plungers 38 are engaged in the recesses 37 by virtue of the biasing action of the springs 43. Thus again the rotors are in the locked position as shown in FIG. 2. The lost motion connection provided by the slot 45 of the clevis 46 and plate 44 permits sufficient flexibility to provide for manufacturing variations in the parts so as to guarantee proper function at all times.

Thus the arrangement indicated provides a positive lock which is easily operated for disengaging the doors and which also is automatically operable and locked when the doors are again swung to their closed positions by the track side cam arrangements.

What is claimed is:

1. In a railway hopper car including a hopper having a discharge opening, a door pivotally connected to said hopper for downward and lateral swinging movement relative to said opening between closed and open positions, the improvement including a locking arrangement comprising:

a lock housing supported on said hopper adjacent said discharge opening, said housing having a cylindrical cavity including an open end slot defining a gathering jaw, a cylindrical lock rotor generally concentrically rotatably supported in said cavity, said rotor including an open end notch registering in one open position of said rotor with said gathering jaw, a lock member on said door being engageable within said notch during swinging movement of said door to a closed position thereby rotating said rotor and notch out of registry with said gathering jaw into lock position to lock said door over said opening and yieldably biased locking means for releasable engagement of said rotor to lock the same against rotation in said lock position, said locking means being located to bias said rotor in impact opposition to said lock member coincident with said notch and said gathering jaw being in registry.

2. The invention in accordance with claim 1, said locking means including, a reciprocating plunger, and a recess in said rotor engaged by said plunger in said lock position.

3. The invention in accordance with claim 2, including biasing means on said housing urging said plunger into said rotor recess.

4. The invention in accordance with claim 3, said housing including a slideway within which said reciprocating plunger is positioned, an actuating link connected to said plunger for reciprocating the same, said biasing means including, a spring held captive within said slideway.

5. The invention in accordance with claim 2, including biasing means urging said plunger into said recess in one position of said rotor and against the outer peripheral surface of said rotor in another position.

6. The invention in accordance with claim 2, including linkage means connected to said plunger for retracting said plunger from locking engagement with said rotor.

7. The invention in accordance with claim 6, said linkage means including a pair of links interconnected by lost motion connecting means.

8. The invention in accordance with claim 7,
including first and second biasing means for urging said plunger into locking relation with said rotor,
said first biasing means being in engagement with said plunger, and
said second biasing means being connected to said linkage means.

9. The invention in accordance with claim 1,
including stop means on said rotor and said housing for limiting rotation of said rotor between open and lock positions.

10. The invention in accordance with claim 9,
said stop means including;
a stop pin projecting into said cavity,
and a peripheral recess within said rotor having end wall portions alternately engaged by said stop pin in the open and closed positions of said rotor.

11. The invention in accordance with claim 1,
including an elongated notch in said housing,
and said locking means including a pin slidingly disposed within said elongated notch,
said pin being visible to indicate the lock or unlock position of said locking means relative to said rotor.

12. In a railway hopper car including a hopper having a discharge opening, a door pivotally connected to said hopper for downward and lateral swinging movement relative to said opening between closed and open positions, the improvement including a locking arrangement comprising;
a lock housing supported on said hopper adjacent said discharge opening,
said housing having a cylindrical cavity including an open end slot defining a gathering jaw,
a cylindrical lock rotor rotatably supported in said cavity,
said rotor including an open end notch in one open position of said rotor registering with said gathering jaw,
a lock member on said door during swinging movement of said door to a closed position being engageable within said notch thereby rotating said rotor and notch out of registry with said gathering jaw into lock position to lock said door over said opening,
stop means on said rotor and said housing for limiting rotation of said rotor between open and lock position,
said stop means including,
a stop pin projecting into said cavity,
a peripheral recess within said rotor having end wall portions alternately engaged by said stop pin in the open and closed positions of said rotor,
an elongated notch in said housing,
and locking means including a pin slidingly disposed within said elongated notch,
said pin being visible to indicate the lock or unlock position of said locking means relative to said rotor.

13. In a railway hopper car including a hopper having a discharge opening, a door pivotally connected to said hopper for downward and lateral swinging movement relative to said opening between closed and open positions, the improvement including a locking arrangement comprising;
a lock housing supported on said hopper adjacent said discharge opening,
said housing having a cylindrical cavity including an open end slot defining a gathering jaw,
a cylindrical lock rotor rotatably supported in said cavity,
said rotor including an open end notch in one open position of said rotor registering with said gathering jaw,
a lock member on said door during swinging movement of said door to a closed position being engageable within said notch thereby rotating said rotor and notch out of registry with said gathering jaw into lock position to lock said door over said opening,
said housing having locking means releasably engaging said rotor to lock the same against rotation in said lock position,
said locking means including,
a reciprocating plunger,
and a recess in said rotor engaged by said plunger in said lock position,
linkage means connected to said plunger for retracting said plunger from locking engagement with said rotor,
said linkage means including a pair of links interconnected by lost motion connection means.

14. The invention in accordance with claim 13,
including first and second biasing means for urging said plunger into locking relation with said rotor,
said first biasing means being in engagement with said plunger, and
said second biasing means being connected to said linkage means.

15. In a railroad hopper car including a hopper having a discharge opening, door means pivotally connected to said hopper for swinging movement relative to said opening between door closed and open positions, the improvement including;
door locking and unlocking linkage means having a locking arrangement couplable with said door means connecting with one end thereof, and door unlocking and locking operating means connecting with the other end of said linkage means for unlocking the locking arrangement and for returning the linkage means to a closed door locking position prior to the locking arrangement moving to a closed door locking position,
first biasing means connecting with said locking arrangement urging said locking arrangement to a door locking position,
second biasing means connecting with said operating means and said linkage means and urging said linkage means toward a door locking position, and
lost motion connection means connecting with said linkage means and said first biasing means and operable to allow said linkage means to be urged to said door locking position prior to the locking arrangement moving to the door locking position.

16. The invention in accordance with claim 15, and
said locking arrangement including a locking jaw rotor member having a first notch,
a housing means about the rotor member having a second door receiving notch for registry with said first notch, a plunger within the housing and a recess in the rotor cooperative to receive the plunger for maintaining the notches out of registry with one another attendant to retaining the door means in the locked position, the door having previously engaged the notches when in registry, and moved the notches out of registry, said first biasing means urging said plunger into said recess for holding the door means by the rotor notch in the locked position.

17. The invention in accordance with claim 16, and said plunger carrying a flag means visible from the exterior of the housing indicating when the locking arrangement is in the door locked position.

18. The invention in accordance with claim 16, and stop means on the housing and the rotor member limiting movement of the rotor member attendant to registry of the notches.

19. The invention in accordance with claim 16, said operating means including a crank arm having an outer end connecting with the second biasing means and with the linkage means coupling with the first biasing means.

20. The invention in accordance with claim 15, and each of said biasing means comprising spring means.

21. The invention in accordance with claim 15, and said linkage means including first and second link sections, said lost means motion connection means including a slot portion of the first link section and a pin portion of the second said link section cooperative with the slot portion for relative movement of the first link section with respect to the second link section.

22. The invention in accordance with claim 15, said door means including a pair of opposed doors on each side of the hopper for closing each hopper side, said linkage means including a pair of link units, said first biasing means including a pair of biasing units, said lost motion connection means including a pair of lost motion connection units, said locking arrangement including a pair of locking units, said operating means including a pair of operating parts, each of said doors having its own lock units operatively associated with its own biasing unit, lost motion connection unit, link unit and operating part, whereby each lock unit can be in door locking position independently of the other lock unit.

23. The invention in accordance with claim 22, and said operating means being a crank and each of said operating parts being an arm of said crank constrained for movement with the other arm.

24. The invention in accordance with claim 15, said second biasing means being connected to said operating means and said linkage means being connected to said operating means and to said lost motion connection means and said locking arrangement being connected to said lost motion means.

* * * * *